US006558273B2

(12) United States Patent
Kobayashi et al.

(10) Patent No.: US 6,558,273 B2
(45) Date of Patent: May 6, 2003

(54) METHOD FOR MANUFACTURING A GOLF CLUB

(75) Inventors: Kenji Kobayashi, Niigata-ken (JP); Masaei Tsurumaki, Niigata-ken (JP)

(73) Assignee: K. K. Endo Seisakusho, Niigata-ken (JP)

( * ) Notice: Subject to any disclaimer, the term of this patent is extended or adjusted under 35 U.S.C. 154(b) by 27 days.

(21) Appl. No.: 09/864,849

(22) Filed: May 24, 2001

(65) Prior Publication Data

US 2002/0022534 A1 Feb. 21, 2002

Related U.S. Application Data

(63) Continuation-in-part of application No. 09/454,426, filed on Dec. 3, 1999.

(30) Foreign Application Priority Data

Jun. 8, 1999 (JP) ..... 11-160193
May 24, 2000 (JP) ..... 2000-153101

(51) Int. Cl.[7] ..... A63B 53/04
(52) U.S. Cl. ..... 473/349; 148/669

(58) Field of Search ..... 473/324, 349, 473/342; 29/428, 228; 148/669, 670, 671; 72/341

(56) References Cited

U.S. PATENT DOCUMENTS 4,067,734 A * 1/1978 Curtis et al. ..... 75/175.5
5,464,216 A * 11/1995 Hoshi et al.
6,071,200 A * 6/2000 Song ..... 473/324
6,391,128 B2 * 5/2002 Ueda et al. ..... 148/669

* cited by examiner

*Primary Examiner*—Steven Wong
(74) *Attorney, Agent, or Firm*—Quarles & Brady LLP

(57) ABSTRACT

A method for manufacturing a golf club with an improved durability which realizes so thin a club head that the head can be enlarged, suppressing the increase of the total weight. A cold rolled material, which is a beta type titanium alloy in a beta single phase and subjected to direct aging, is used for the head. Preferably, the material is subjected to at least 15% cold rolling reduction. The aging is able to improve durability and surface hardness. Due to the direct aging of the cold worked material without solution treatment, such a long time heat treatment is no longer necessary, thereby resulting in the reduction of production costs.

10 Claims, 3 Drawing Sheets

METHOD FOR MANUFACTURING A GOLF CLUB

CROSS REFERENCE TO RELATED APPLICATIONS

This application is a continuation-in-part application of U.S. application Ser. No. 09/454,426 filed on Dec. 3, 1999, and now pending.

BACKGROUND OF INVENTION

1. Field of the Invention

The present invention relates to a method for manufacturing a golf club, particularly to a material used in the method.

2. Description of the Prior Art

In a golf club head, one of means for enlarging the sweet area, i.e., an area on a face where a ball travels comparatively straight and well when struck thereon, is to large-size a club head itself. In recent years, some heads with more than 300 cc volume have come onto the market. Even if a club head is large-sized, yet the total weight thereof must be suppressed so as to ensure the easiness to handle. As a result, the head must be formed hollow inside, and its outer shells must be thinned. However, thinned outer shells generally lead to decreased strength of a club head, even to the likelihood of the head being damaged due for example to the impact force at the time of striking balls. As you need ensure sufficient strength of a face for striking balls, a face has heretofore been formed to at least 3.0 mm thickness.

The main current of recent golf clubs has been directed to titanium or titanium alloy head. As titanium alloy is lighter but stronger than stainless steel, the degree of freedom in designing a head is increased, thereby generally enabling the manufacture of a club head which is larger than a head made of stainless steel. Consequently, the sweet area is enlarged, as mentioned above, so that the stable flight of golf balls can be obtained.

Conventional titanium alloy based materials for a golf club head have been alpha+beta type alloys such as Ti-6Al-4V alloys and Ti-4.5Al-3V-2Fe-2Mo alloys, or beta type alloys such as Ti-15V-3Cr-3Sn-3Al alloys, and etc. The Ti-6Al-4V alloys have been most frequently used among such titanium alloys in various industrial fields, which however, are not suitable for cold working, and thus a great deal of labor and costs have been required to form a plate to a 1 to 5 mm thickness, the dimension generally required for the materials of a golf club. Therefore, casting has been employed for manufacturing such Ti-6Al-4V alloy made head, as disclosed in Japanese Patent Un-Examined Publication No.3-230845. However, as titanium is an easily oxidizable metal, casing is not able to be carried out in the atmosphere. Further, titanium is easily reacted with a casting mold, and thus extremely high technology is required, thereby eventually leading to increased costs. In addition to the foregoing, castings have a drawback of resultant inferior strength, because they can not undergo tissue-control as compared to rolled materials. In contrast, ultra plasticity working is possible for the aforesaid Ti-4.5Al-3V-2Fe-2Mo alloys, and thus high strength is more easily obtained by the alloys than by castings. However, as even the plasticity working requires special installations, and is highly time-consuming, the method is not suitable for mass production. Under the above-mentioned circumstances, beta type alloys with better working ability, such as Ti-15Mo-5Zr-3Al and Ti-15V-3Cr-3Sn-3Al, have more often come to be used.

These alloys are formed by cold working to a preset thickness, and then are subjected to thermal treatment for removing distortions caused by cold working and undergoing solution treatment, thereby assembling them into a golf club head.

For related prior art, Japanese Un-Examined Patent Publication No.9-59731 discloses a titanium alloy for golf club head, said titanium alloy containing: zirconium and oxygen by the amounts in the ranges satisfying the following inequalities: the weight percentage content of $Zr \geqq 1.0(\%)$, in which $Zr+25O_2 \geqq 5(\%)$, and $3 \times Zr+220 \times O_2 \leqq 86(\%)$; a slight amount of at least one selected from among aluminum, tin, copper, and chromium; and titanium and inevitable impurities as the remaining components. This prior art also teaches the manufacture of a face of a golf club head by subjecting such titanium alloy to final rolling to effect 30% or more reduction in area, at 700° C. or below. In the prior art, such titanium alloy is referred to as alpha type titanium alloy. In fact, Zr is not a beta stabilized element. Further, the prior art publication refers to the difficulty in cold working in a case where a beta stabilized element is added. Accordingly, the art disclosed by this prior art publication is not intended for beta type titanium alloy.

On the other hand, Japanese Un-Examined Patent Publication No.11-19255 describes that the face member and head body member of a golf club head are each formed from beta-type titanium alloy. The prior art publication discloses a method for manufacturing a golf club head such that the face member is subjected to cold or hot forging to become plastically deformed to have a predetermined configuration. This prior art publication also describes that the face member can have a thickness of about 2.7 mm at the central portion thereof. Although this prior art teaches the use of cold or hot forging as a method of working the face member of a golf club head, it is silent with any advantage such as the improvement of durability to be resulted therefrom, only describing that any suitable methods may be selectively used for forging, irrespective of either cold or hot forging, and thus, it only refers to the types of forging as examples. In fact, cold working is generally subjected to a large deformation resistance, resulting in inferior workability, so that it is difficult to carry out. Accordingly, it is unlikely for those skilled in the art to select cold working. Further, even though the techniques disclosed by the prior art is used to cold work a beta type titanium alloy, yet it is not possible to manufacture a good club head. In other words, whilst a titanium alloy has extremely high specific tensile strength (strength/density) and corrosion resistance among practical metallic materials, and thus it has higher specific tensile strength and corrosion resistance than steel materials such as S45C, yet it has a drawback that due to its poor cold working ability, the cold working of a beta type titanium alloy is not a suitable method for manufacturing a face of a golf club head.

Whereas, Japanese Un-Examined Patent Publication No.9-215786 discloses that the face member of a golf club head is formed from a beta type titanium alloy. Specifically, this prior art publication discloses that when manufacturing the face member, a shoulder round bar is heated up to a temperature range for hot working and then die-forged to obtain a desired shape thereof, which is then subjected to direct aging treatment without solution treatment, to thereby form the face member having desired properties including desired strength. This prior art further describes that as the solution treatment is omitted after the hot die-forging, the production process is simplified, and the strength is enhanced due to the synergy of work hardening and age hardening. However, even if the material is subjected to direct aging treatment after the hot die-forging process, the strength thereof is still too small for the material to be used for that of the face member that is required to have the smallest possible thickness, and thus it is inevitably cracked due to the impact at the time of striking balls.

Also, Japanese Un-Examined Patent Publication No.10-71219 discloses a forging step in which a titanium-made material bar is heated to hot forging temperature and die-forged to form the face member, and an aging treatment step for subjecting the same to aging treatment without solution treatment after the forging step. However, if the direct aging treatment is performed after the hot die-forging step, yet the same problem as mentioned in the foregoing paragraph occurs for the same reasons.

Also, Japanese Un-Examined Patent Publication No.5-70909 discloses a method of manufacturing an aluminum alloy pipe for use with hydraulic machines, in which an aluminum alloy ingot is hot extruded, drawn, and then subjected to aging treatment. Specifically, this prior art discloses that the reduction in cross sectional area after the drawing process should be 15 to 25%, relative to the cross sectional area after the hot extrusion process. This prior art publication teaches that the reason why the 15–25% reduction in cross sectional area by the drawing process, which, in other words, is 15–25% cold work reduction, is preferred is that in the case of the reduction of 15% or below, the introduction of cold strain is too little to obtain sufficient strength even through the aging treatment, while in the case of the reduction of 25% or above, lowered ductility is resulted thereby leading to lowered formability in bending process or pipe-enlarging process. However, it should be noted that the prior art includes no teachings nor suggestions concerning the manufacture of a golf club. Further, it is true that cold reduction is referred to therein, but a beta type titanium alloy has such a poor cold working ability in general that it is not suitable for the manufacture of the face member of a golf club head.

Also, in Japanese Un-Examined Patent Publication No.62-151551 is disclosed a method of manufacturing a Ti-15V-3Cr-3Sn-3Al titanium alloy for use as a cold worked material, in which the alloy is subjected to solution heat treatment by retaining it at 830 to 1150° C. for 3 minutes to 5 hours and then cooling it at more than 18° C./minute cooling rate, which is then cold worked to more than 50% cold reduction.

Specifically, this prior art publication teaches that the advantage of more than 50% cold rolling rate is in that with more than 50% rate, the crystal particle size of the re-crystallized material that was subjected to high temperature preliminary solution treatment, cold rolling and then solution treatment becomes smaller than that of the material that was subjected to low temperature preliminary solution treatment, cold rolling, and then solution treatment. The prior art also mentions solution aging treatment, and describes that the titanium or titanium alloy thus obtained is suitable as a material for a rocket ship, various kinds of chemical plants, desalination plant and the like, but it does not include any descriptions relating to golf club head. Further, cold working reduction is referred to therein, but a beta type titanium alloy generally has such a poor cold working ability that it is not suitable for the manufacture of the face member of a golf club head.

In recent years, however, a face has been required to be thinned still further in order to make a ball travel a still longer distance, which has caused a problem such that beta type alloy materials of golf club head which are manufactured by the above-mentioned conventional processes are not strong enough to prevent the cracks from developing due to the impact force at the time of striking balls. The cracks are presumably due to a face being too much thinned to a thickness of less than 3 mm when only a face of 3 mm or above could withstand the impact.

SUMMARY OF THE INVENTION

To eliminate the above-mentioned problems, it is, therefore, a primary object of the present invention to provide a method for manufacturing a golf club with excellent durability.

To attain the above object, there is proposed, from a first aspect of the invention, a method for manufacturing a golf club having a head, which comprises the steps of forming a beta type titanium alloy material into a plate material of a preset thickness by cold rolling so that cold rolling reduction may be 15% or above. Specifically, as cold rolling is employed as cold working, the forming of a beta type titanium alloy to a thin thickness by cold rolling leads directly to the forming of the face member close to a preset thin thickness. Thus, if a beta type titanium alloy generally has a poor cold working ability, yet it is possible to easily form the face member to a preset thin thickness, such as 3 mm or below, by cold rolling the same. Further, due to the cold rolling, deformation speed can be lowered, thereby making cracks less likely to occur. Furthermore, with such enhanced cold rolling reduction of 15% or above, the work-hardening caused by the cold working is allowed to remain, thus improving the durability and surface hardness of the material.

From a second aspect of the invention, there is also proposed a method for manufacturing a golf club, further comprising the step of subjecting the face member to direct aging treatment. With such aging, the durability and surface hardness of the material can be improved. Further, by subjecting the cold rolled material to direct aging without solution heat treatment, there is no longer need of such a long heat treatment time to obtain a sufficient hardness, due to work hardening by cold rolling as well as aging precipitation that proceeds more rapidly, whereby manufacturing costs can be suppressed.

From a further aspect of the invention, there is proposed a method for manufacturing a golf club, further comprising the steps of hot rolling a beta type titanium alloy material into a beta single phase by control of temperature and then forming the material into a plate material of a preset thickness by cold rolling.

Whilst a beta type alloy is an alloy of so-called precipitation hardening type to allow the precipitation of an alpha phase in a beta phase by aging treatment to thereby obtain hardness, the direct aging treatment without releasing distortions or strains caused by working a head structuring member through cold rolling and pressing, can facilitate the precipitation of an alpha phase, without removing the effect of work hardening generated by cold working so as to leave the same effect at such a low temperature needed for aging, whereby a high strength can be obtained in a short time. Furthermore, as such beta single phase has neither a two-layer tissue nor a fragile tissue, no cracks will be developed at the time of cold or hot press working.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Hereinafter is explained an embodiment of a golf club of the invention with reference to the attached drawings.

Figure 1:
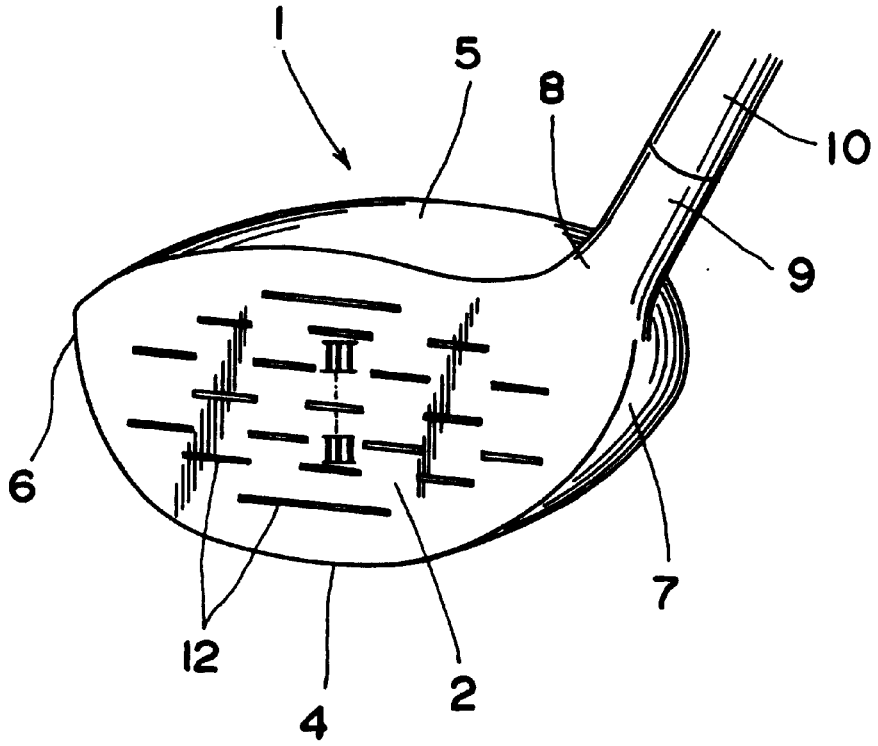
FIG. 1 is a perspective view showing a golf club of an embodiment of the invention.
Figure 2:
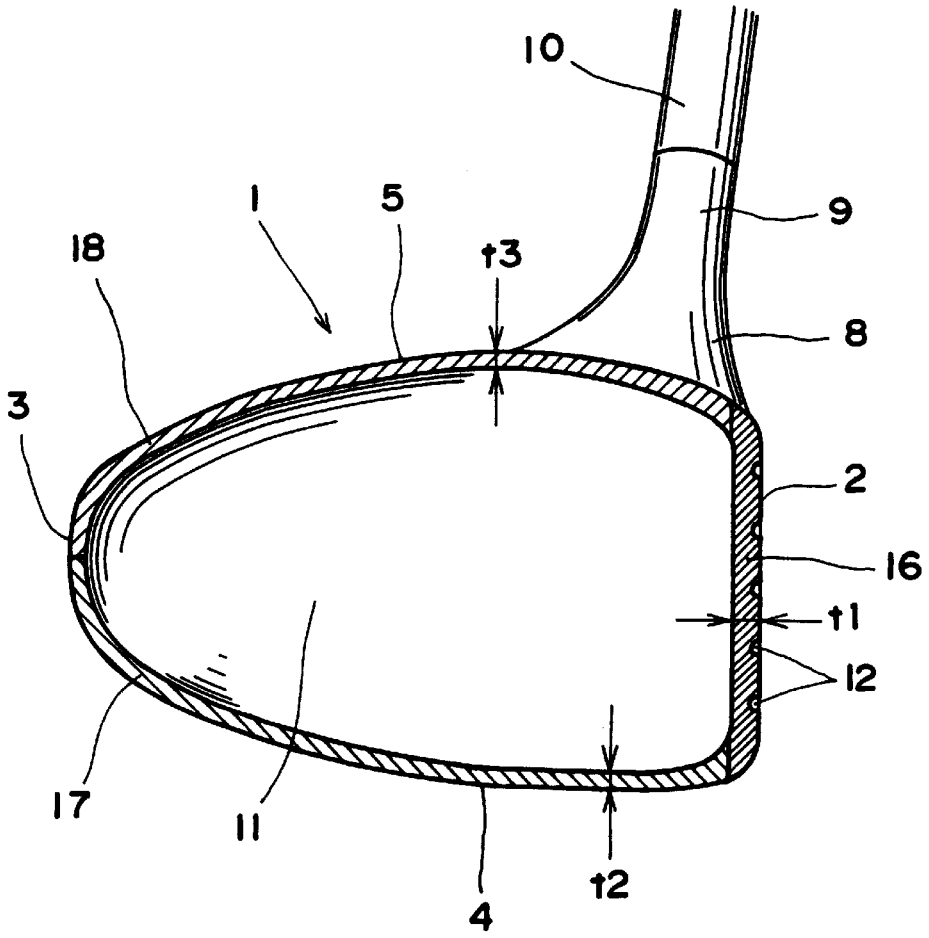
FIG. 2 is a section of a golf club of FIG. 1.

FIGS. 1 and 2 illustrate one example of a golf club in accordance with the invention. The golf club is a wood club, or a so-called metal wood with a metallic, hollow head 1. The head 1 comprises a face 2 for striking balls on a front face, a back 3 at a rear side, a sole 4 at a lower part, a crown 5 at a top part, a toe 6 at one side and a heel 7 at the other side, respectively. An upper part of the heel 7 is formed with a neck 8, from which extends a hose 19 upwardly. The hose 19 serves as a shaft connector for connecting a shaft 10 thereto. The head 1 has a hollow interior 11, which may be filled with suitable filler such as polyurethane. Further, the face 2 is formed with a plurality of grooves called score lines 12.

The head 1 is constructed of three shells, namely, a tabular face member 16, a body member 17 and a crown member 18 which construct the outer shell of the head 1. The face member 16 constructs the face 2, while the crown member 18 constructs the crown 5, and the body member 17 the remaining portions such as the back 3 and the sole 4. These face member 16, body member 17 and crown member 18 are joined together by means of welding or the like. In the meantime, the head 1 may be divided in a different manner than the above-mentioned, into for example two pieces with one piece making up of the face 2 side while the other the back 3 side, or into four or more pieces.

Figure 3A:
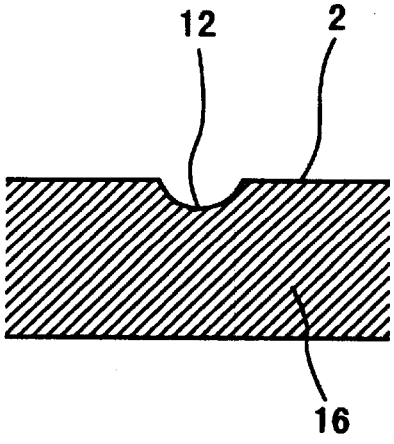
FIG. 3(A) is a section of a golf club of FIG. 1, taken along III—III line thereof, particularly illustrating a state without cracks.
Figure 3B:
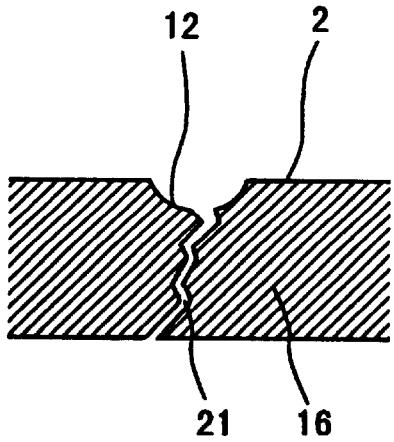
FIG. 3(B) is a section of a golf club of FIG. 1, taken along III—III line thereof, particularly illustrating a state with cracks.

In the event that the head 1 made of conventional materials is thinned, cracks are liable to occur due to impact at the time of striking balls. After investigating the cracks thus caused, a finding followed that splits did not occur in portions which were considered short of strength, such as welded parts, but in bottom portions of score lines so that the splits developed therein spread all over the face 2 to thereby cause cracks. FIG. 3 illustrates score line 12 as well as how its crack 21 occurred. A further finding followed that such tendency toward cracks are observed mainly on the bottom portions of the score lines 12 located in the center of the face 2. Analyzing such phenomenon from a material strength's point of view revealed that the load of more than 1 ton or above was applied to the face 2 at the time of striking a ball, and thus the entire face 2 was bent toward the inside of the head 1 due to the shortage of strength, so that a stress thus developed was concentrated upon the bottom portions of the score lines 21, which resulted in the facilitating and developing of the cracks. To prevent such phenomenon, it was found out that the improvement of the durability and surface hardness of a material is necessary from an aspect of material. It should be noted that improved durability can compensate for the shortage of strength of the thinned face 2, preventing the same from being bent toward the inside of the head 1 at the time of striking balls. Also, improved surface hardiness can prevent the local deformation of a ball striking portion, dispersing the aforesaid stress concentrated upon the bottom portions of the score lines 12 toward peripheral portions. Furthermore, the durability of the material properly improved to the extent that it does not become fragile can contribute, fortunately, to the improvement of fatigue characteristics of the material itself, having an effect on the prevention of cracks 21.

To reflect the aforesaid material analysis result to material characteristics, various experiments were repeatedly performed, which were followed by a finding that to attain the aforesaid object through the effective use of conventional manufacturing apparatus, the face 2 must be subjected to an optimal aging treatment thereby to obtain durability and surface hardness sufficient enough to prevent the cracks from developing. As a result, optimal material characteristics have been grasped. On the other hand, the aging condition for obtaining higher durability than in the past, requires extremely long heat treatment time, which brought about another problem of production costs being drastically increased.

Through the study and review to solve this new problem, it was found out that the problem could be solved by subjecting a golf club product which was worked up to a stage of determining a product thickness to direct aging without solution treatment. Based on this finding, there could be obtained a golf club head made of titanium alloy which has excellent durability. That is, a golf club of the invention employs a cold rolled material, particularly a cold rolled beta type titanium alloy in a beta single phase that was subjected to direct aging treatment, for the material of the head constructing members 16, 17 and 18, particularly for that of the face 16. In a preferred form of the invention, the employed material should indicate at least 15% cold rolling reduction.

As above discussed, a beta type titanium alloy has heretofore been used for a material of the face member of a golf club, with the aged tissues from the re-crystallization state. According to the prior art, however, long hours of aging treatment at comparatively high temperature (at 500° C. for eight hours, for example) must be performed (full aging), in order to obtain comparatively even tissues and substantial strength. Although it is possible to obtain more even aged tissues through the aging treatment at 400 to 450° C. for dozens of hours, hardness becomes too high when such even tissues have been obtained, and thus the material would have inferior ductility, particularly indicate poor tenacity in the case that cutouts are present in the product.

Further, irrespective of whether it is cold aging or hot aging, the priority precipitation of alpha phase into grain boundary is inevitable, and thus sufficient toughness to compensate for the thinned thickness cannot be obtained, so that durability is impaired.

In contrast, if alpha phase is allowed to precipitate from tissues which are not re-crystallized yet, the priority precipitation of alpha phase into the grain boundary is suppressed, so that the alpha phase is allowed to precipitate speedily in the grain and the grain boundary to substantially the same extent, thus facilitating the precipitation of alpha phase substantially over an entire region. As a result, if aging is not fully performed to reach a fully aged state, yet even tissues can be obtained, and if the alpha phase is not fully precipitated, yet the material can obtain certain strength, thus maintaining high ductility as well as high tenacity. Whilst the foregoing advantageous effects can be realized through cold rolling of several percentages' cold reduction, such as so-called skin pass rolling, the durability of the material can be enhanced noticeably preferably at 15% or more cold rolling reduction. Further, with the beta grain being kept fine enough in the beta phase, better ductility can be obtained, as is well known.

The reason why the titanium alloy tissue prior to aging is in a beta single phase in the present invention, is that the presence of fragile tissues such as alpha+beta two-phase tissue or omega tissue could develop cracks when cold or hot pressing the head constructing members. Further, the reason why the material prior to aging step has to have the cold rolled tissues in the invention is to obtain sufficient strength when aging the head 1 at the final stage. Tissues subjected to solution heat treatment are, unlike the cold rolled tissues, not able to realize sufficient strength through a short-time aging, thus leading to a likelihood of developing cracks or the like due to impact at the time of striking balls. Further, at least 15% cold rolling ratio can fully realize this advantageous effect. In addition, the direct aging treatment without solution heat treatment in the heat treatment of the head 1 is aimed at obtaining higher strength by subjecting the head 1 to direct aging.

As above mentioned, the head 1 is formed from the material having cold rolled tissues, said material being subjected to aging without solution heat treatment, thereby obtaining high strength.

Whilst a beta type alloy is an alloy of so-called precipitation hardening type to allow the precipitation of an alpha phase in a beta phase by aging treatment to thereby obtain hardness, the direct aging treatment without allowing solution heat treatment to release distortions developed by working the head structuring members through cold rolling and pressing, can facilitate the precipitation of an alpha phase, and leave the work hardening effect generated by the cold rolling step even at such a low temperature needed only for aging, without removing such effect, as compared to the aging treatment of the material after the solution heat treatment. Through the foregoing two advantageous effects, a higher strength can be obtained in a short time.

Although high strength can be realized by using materials manufactured according to conventional methods, yet it would require a long-time aging treatment, so that some disadvantages would occur such as the increase of manufacturing costs and the decrease of productivity. Thus, they are unlikely to provide realistic solution to the above-mentioned problems.

members of respectively preset shapes (i.e., said face member 16, body member 17 and crown member 18) by means of hot or cold pressing and then assembling these members into the head 1 by joining them together by welding; subjecting the head 1 thus obtained to aging treatment; and assembling a golf club by connecting the shaft 10 to the head 1.

It should be noted, however, that a particular attention must be paid to the hot rolling step in order to effectively work the invention.

In the event that any other phase than the beta phase precipitates due to the hot rolling, a solution heat treatment is necessary thereafter, in order for the subsequent cold working step to be performed with no problems. However, temperature control, if possible, to finish to the beta single phase only during the hot rolling, would enable the manufacturing at low costs. In addition to that, by developing distortions during the hot rolling step, sufficient work hardening can be obtained, even though the subsequent cold working is not carried out sufficiently, thereby realizing low-cost manufacturing.

Another attention needs to be paid to the cold working as well. With conventional methods where solution heat treatment is performed after the final working, configurations could be corrected by heating during the treatment. In a preferred form of the invention where no solution heat treatment is performed after the cold working, such correction is not carried out and thus full configurations must be preformed by the cold working step.

Also, a further attention needs to be paid to the problem of the absorption of hydrogen. The beta type titanium alloy is liable to absorb hydrogen, and thus if the absorption of hydrogen has taken place, it must undergo high temperature heat treatment in either vacuum or Ar ambient atmosphere. Although dehydrogenation was possible through the solution heat treatment in the conventional methods, which would be accompanied by difficulties, a particular attention must be paid not to absorb hydrogen during the steps in the invention. Specifically, as acid cleaning is a step which is liable to cause the absorption of hydrogen, acid cleaning liquid such as solution of hydrofluoric acid and nitric acid, temperature and time for acid cleaning must be carefully controlled.

TABLE 1

| Working Condition | Aging Condition | Hardness:HV1.0 | Durability(N/mm$^2$) | Remarks |
|---|---|---|---|---|
| solution treatment | 450° C./8 hours | 341 | 997 | 1st comparative example |
| solution treatment + 10% cold working | 450° C./8 hours | 357 | 1038 | 1st embodiment |
| solution treatment + 15% cold working | 450° C./8 hours | 393 | 1179 | 2nd embodiment |
| solution treatment + 30% cold working | 450° C./8 hours | 415 | 1244 | 3rd embodiment |
| solution treatment + 50% cold working | 450° C./8 hours | 450 | 1387 | 4th embodiment |
| hot rolling + direct 30% cold working | 450° C./8 hours | 427 | 1262 | 5th embodiment |

A preferred method for manufacturing a golf club of the invention comprises the steps of: producing an ingot from an alloy material of required composition by means of arc welding; forming the ingot into plate materials of a preset thickness by means of hot and cold rolling; fabricating The above table 1 shows the result of measurement of post-aging hardness and durability concerning the respective materials. More precisely, a beta type alloy or Ti-15V-3Cr-3SN-3Al alloy was hot rolled and then solution treated, which was either cold rolled or not cold rolled, and then subjected to aging treatment for investigating the changes of hardness. The condition for aging treatment was 450° C. for 8 hours for all the samples.

As is clearly seen from the table 1, whilst the hardness of a material that was hot rolled and then solution treated was not more than 341 even through the aging for 8 hours at 450° C., the hardness of the material which was further through the cold rolling was increased after the aging under the same condition. This is due to the work hardening effect caused by the cold rolling and the aging precipitation having proceeded more rapidly. Specifically, when cold rolling ratio was 15% or above, these effects appeared more noticeably. Further, it turned out that when the hot rolled material was direct cold rolled, and then subjected to aging treatment without solution heat treatment, the hardness became still higher. Although the embodiments are under the same aging condition at 450° C., the same effects were acknowledged of under lower temperature conditions such as at 400° C. or at 300° C. Although the similar effects could be obtained even in a range higher than 450° C., the age hardening will not proceed at 600° C. or above, and distortions will be removed or the re-crystallization will occur in such higher temperature range, so that the effects are likely to be decreased. In other words, the aging temperature is preferably in a range of from 300° C. to 600° C.

TABLE 3

| No. | Thickness of face (mm) | Preset head speed (m/s) | The number of trials | Head speed (m/s) | Ball speed (m/s) | Travelling distance (yard) carry | run | total |
|---|---|---|---|---|---|---|---|---|
| (1) | 3.0 | 40 | 1 | 40.1 | 53.7 | 177 | 20 | 197 |
| | | | 2 | 40.2 | 54.0 | 177 | 28 | 205 |
| | | | 3 | 40.0 | 54.1 | 178 | 26 | 204 |
| | | | 4 | 40.2 | 53.8 | 179 | 20 | 199 |
| | | | 5 | 39.9 | 54.1 | 181 | 22 | 203 |
| | | | Average | 40.1 | 53.9 | 178 | 23 | 202 |
| (2) | 2.7 | 40 | 1 | 40.7 | 54.8 | 186 | 21 | 207 |
| | | | 2 | 40.7 | 54.8 | 186 | 21 | 207 |
| | | | 3 | 40.9 | 55.0 | 184 | 23 | 207 |
| | | | 4 | 40.7 | 54.9 | 185 | 22 | 207 |
| | | | 5 | 40.9 | 54.9 | 185 | 24 | 209 |
| | | | Average | 40.8 | 54.9 | 185 | 22 | 207 |

Table 3 shows the result of performance test of a golf club head according to the embodiment, in which a swing robot for striking a golf ball was used to test a golfing driver. In the table 3, (1) indicates a driver of prior art, while (2) a driver according to the embodiment. In other words, (2) was a driver whose constructing members including a face member are made from a beta type titanium alloy in a beta single phase which are cold rolled up 15% reduction or above and then subjected to direct aging treatment, while (1) was the one in which such beta type titanium alloy was subjected to solution treatment and then to aging treatment.

TABLE 2

| Type of face member | Thickness(mm) | Type of Heat treatment | The number of trial strikes to cause cracks | Remarks |
|---|---|---|---|---|
| 30% cold rolled | 2.7 | aging | no cracks even after 5,000 or more trials | 6th embodiment |
| 50% cold rolled | 2.7 | aging | no cracks even after 5,000 or more trials | 7th embodiment |
| 30% cold rolled | 2.7 | solution treatment + aging | 3200 | 2nd comparative example |
| 0% cold rolled | 2.7 | solution treatment | 2500 | 3rd comparative example |
| hot rolled | 2.7 | solution treatment + aging | 2700 | 4th comparative example |
| hot rolled | 2.7 | Solution treatment | 1000 | 5th comparative example |

Conditions:
head speed 48 m/sec.
head volume: 300 cc
face thickness t1: 2.7 mm, sole thickness t2: 1.15 mm, crown thickness t3: 1 mm
aging condition: 400° C. for 8 hours The above table 2 shows the data on the durability of the head 1 made from Ti-15V-3Cr-3Sn-3Al alloy of the invention. The data were taken using a swing robot for golf.

As is apparent from the above, for golf clubs with the face made of materials subjected to the solution treatment only or the solution treatment and the subsequent aging treatment, cracks or depressions appeared on the face 2 during trial striking, indicating inferior results. For the embodiments of the invention where the material was cold rolled and then subjected to the aging treatment, no cracks and depressions were found even after trial striking of 5,000 times, indicating superior results.

With the thickness t1 of the face 2 being 2.7 mm which is smaller than any conventional titanium-made faces of golf clubs, the number of trial strikes to cause cracks apparently differed between the face members 16 of the invention and those not according to the invention. The result well demonstrates that the present invention is particularly advantageous as a golfing driver.

The head of (2) has a face member of 2.7 mm thickness, with a head volume of 300 $cm^3$, while the head of (1) has a face member of 3.0 mm thickness, with a head volume of 250 $cm^3$, both heads defining the same loft angle of 10.5 degrees.

For both heads, head speed was set at 40 m/s, which were not changed throughout the trials, and right-striking angle was approximated to zero to minimize the deviation in the sidewise direction. In the table, numerical values in the column for indicating the head speed are the actual ones obtained by measurement, In the column for traveling distance, "carry" means a distance that a ball traveled in the air, "run" means a distance that a ball traveled on the ground, and "total" means the sum thereof, respectively.

As is apparent from the table 3, the driver (2) of the embodiment of the invention indicated higher initial ball speed. In other words, the average of ball speed was 54.9 m/s in the driver of (2), while it was 53.9 m/s in the driver of (1) or conventional driver, and thus the speed was improved by 1 m/s (1.8%). Further, the average of "carry" and the average of "total" were 185 yards and 207 yards in the driver of (2), respectively, while they were 178 yards and 202 yards in the driver of (1), and thus the ball travelling distance were improved by 7 yards (4%) and 5 yards (2.5%), respectively.

The above result well demonstrates that according to conventional method in which aging treatment is carried out after solution treatment, the face member must have at least 3.0 mm thickness to insure strength, and thus a golf club head cannot be large-sized, so that a great repulsive force against balls can not be expected. According to the technique of the invention, however, the face member are made from a beta type titanium alloy in a beta single phase which are cold rolled up to 15% reduction or above and then subjected to direct aging treatment, it is possible to form the face member as thin as 2.7 mm, thus enabling the large-sizing of a head, so that the repulsive force against balls can be enhanced without sacrificing strength thereof.

Incidentally, the present invention should not be limited to the foregoing embodiments, but may be variously modified within a scope of the invention. For example, the invention is also applicable to iron clubs, though the embodiments take a wood club as an example.

What is claimed:

1. A method of manufacturing a golf club having a metallic hollow head, said head including a face member which has a thickness less than 3.0 mm, formed with a plurality of score lines thereon, the method comprising:

forming said face member from a beta type titanium alloy with a hot or cold press, said beta type titanium alloy being in a beta single phase, cold rolled to 10–50% cold reduction; and forming cold rolled tissues in said face member without subjecting said beta type titanium alloy to a solution treatment so that the durability of said face member ranges from 1038 $N/mm^2$ to 1387 $mm^2$.

2. A method for manufacturing a golf club having a metallic hollow head, said head including a face member which has a thickness less than 3.0 mm, formed with a plurality of score lines thereon, the method comprising:

forming said face member from beta type titanium alloy with a hot or cold press, said beta type titanium alloy being in a beta single phase, cold rolled to 10–50% cold reduction;

forming cold rolled tissues in said face member without subjecting said beta type titanium alloy to a solution treatment, and further subjecting the formed face member to an aging treatment performed in a range from 300° C. to 600° C. so that the durability of said face member ranges from 1038 $N/mm^2$ to 137 $N/mm^2$;

fabricating the head by using said face member thus formed; and attaching the head to a shaft.

3. A method for manufacturing a golf club according to claim 1, wherein said face member has a hardness in a range from Hv 357 to 450.

4. A method for manufacturing a golf club according to claim 2, wherein said face member has a hardness in a range from Hv 357 to 450.

5. A method for manufacturing a golf club according to claim 3, wherein said cold roll reduction rate ranges from 15% to 50%, the durability ranging from 1179 $N/mm^2$ to 1387 $N/mm^2$, and the hardness ranging from Hv 393 to 450, respectively.

6. A method for manufacturing a golf club according to claim 4, wherein said cold roll reduction rate ranges from 15% to 50%, the durability ranging from 1179 $N/mm^2$ to 1387 $N/mm^2$, and the hardness ranging from Hv 393 to 450, respectively.

7. A method for manufacturing a golf club according to claim 5, wherein said beta type titanium alloy is either a Ti-15Mo based alloy or a Ti-15V based alloy.

8. A method for manufacturing a golf club according to claim 6, wherein said beta type titanium alloy is either a Ti-15Mo based alloy or a Ti-15V based alloy.

9. A method for manufacturing a golf club according to claim 7, wherein said face member has a thickness of about 2.7 mm.

10. A method for manufacturing a golf club according to claim 5, wherein said face member has a thickness of about 2.7 mm.

* * * * *